US005829711A

United States Patent [19]

Wu

[11] Patent Number: 5,829,711

[45] Date of Patent: Nov. 3, 1998

[54] SUPPORTING TABLE FOR SPOOLS

[76] Inventor: Jui Yi Wu, No. 298, Ming Shing Street, Qui Shan Hsiang, Tao Yuan Hsien, Taiwan

[21] Appl. No.: 880,834

[22] Filed: Jun. 23, 1997

[51] Int. Cl.[6] ..... B65H 16/02

[52] U.S. Cl. ..... 242/594; 242/129; 242/597.7; 112/302

[58] Field of Search ..... 242/594, 594.6, 242/597.7, 129, 130.3, 130.4, 131, 139; 112/302

[56] References Cited

U.S. PATENT DOCUMENTS

| | | |
|---|---|---|
| 742,883 | 11/1903 | Long . |
| 1,191,904 | 7/1916 | Luick . |
| 1,255,619 | 2/1918 | Lord . |
| 2,545,203 | 3/1951 | Head . |
| 3,347,064 | 10/1967 | Forca . |
| 3,930,385 | 1/1976 | Greczin . |
| 4,261,532 | 4/1981 | Davis et al. . |
| 5,626,302 | 5/1997 | Hrobar . |

FOREIGN PATENT DOCUMENTS

| | | | |
|---|---|---|---|
| 228388 | 11/1956 | Australia | 242/129 |
| 23032 | 9/1921 | France | 242/597.7 |
| 4286574 | 10/1992 | Japan | 242/594 |
| 555045 | 5/1977 | U.S.S.R. | 242/129 |
| 371366 | 4/1932 | United Kingdom | 242/131 |
| 1257793 | 12/1971 | United Kingdom | 242/597.7 |

*Primary Examiner*—Donald P. Walsh
*Assistant Examiner*—William A. Rivera
*Attorney, Agent, or Firm*—Bacon & Thomas

[57] ABSTRACT

A supporting table for spools, comprises a supporting post. A positioning collar is disposed at the lower portion of the supporting post. The positioning collar has a threaded central opening and a raised plateau. A supporting bracket having a central opening is rotationally enveloped onto the raised plateau of the positioning collar. A plurality of spokes and each of the spokes is connected equiangularly to the peripheral of the supporting bracket. The other end of the spoke is provided with a supporting disk and a retaining post in which a spool can be releasably positioned thereof. And a plurality of radial through holes in which a biased spring and a ball are disposed between the supporting collar and the supporting bracket such that the supporting bracket is selectively positioned with respect to the supporting collar. Accordingly, a plurality of spools having different colors and sizes can be disposed on the supporting table for readily use when needed.

3 Claims, 7 Drawing Sheets

SUPPORTING TABLE FOR SPOOLS

FIELD OF THE INVENTION

The present invention relates to a supporting table, more particularly, to a supporting table for spools. According to a preferred embodiment of the present invention, a plurality of spools having different colors and sizes can be readily disposed thereon for readily use when it is needed. By this arrangement, changing a new spool or replacing an exhausted spool can be eliminated.

DESCRIPTION OF PRIOR ART

In the conventional sewing machines, both for industrial and family use, are provided with a spool having a thread thereof. When the stitching starts, the thread on the spool is continuously withdrawn and is stitched onto the fabric sheets. Finally, the fabric sheets to be sewed are connected.

However, there are a plurality of stitching processes to be performed and different sizes and colors of threads are required during processing. As a matter of fact, the conventional sewing machine is only provided with a mounting post for spool. In case the existing spool is exhausted or needs to be replaced, the operator needs to firstly select a new one and then mount this select one to the sewing machine. It will take a great deal of time in changing the spool since the subsequent routing of the thread really takes time. As a result, a great deal of precious time will be exhausted because of change threads of different sizes and colors. Consequently, the cost is also increased.

SUMMARY OF THE INVENTION

It is the objective of this invention to provide a supporting table for spools which comprises a supporting bracket rotationally disposed on a polygonal positioning collar. A plurality of spokes are provided and each of the spokes is equiangularly connected to the peripheral of the supporting bracket at one end. The other end of the spoke is mounted with a supporting disk having a retaining post thereof. By this arrangement, a plurality of spools having different colors and sizes can be readily supported by the supporting table for immediately use. The free end of the thread of the spool can be readily clipped and cut by a clipping plate and cutting blade disposed at the supporting disk. The time spent on the routing is therefore reduced.

BRIEF DESCRIPTION OF DRAWINGS

In order that the present invention may more readily be understood the following description is given, merely by way of example with reference to the accompanying drawings, in which.

DETAILED DESCRIPTION OF PREFERRED EMBODIMENT

Figure 1:
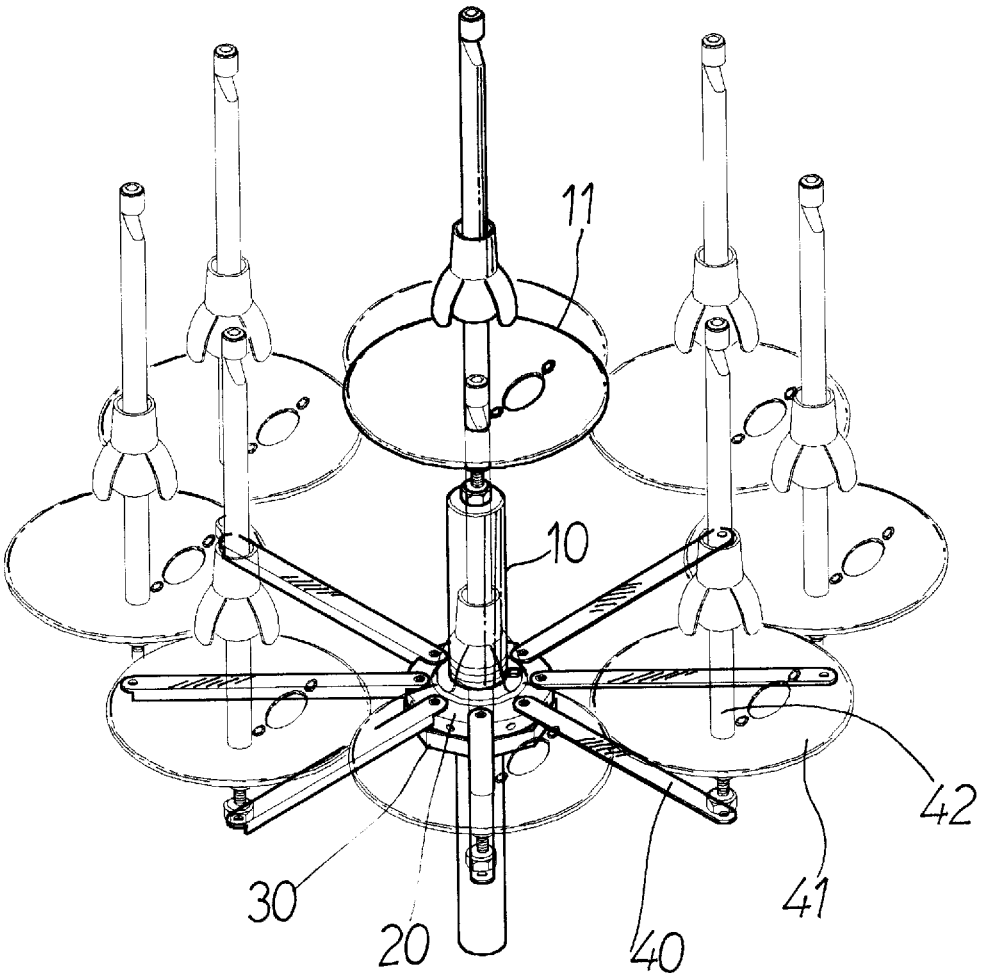
FIG. 1 is a perspective view of the supporting table for spools.

Referring to FIG. 1, the supporting table made according to the present invention generally comprises a supporting column 10 having a positioning collar 30 disposed at the lower portion. A supporting bracket 20 is rotationally disposed above the positioning collar 30 and which is provided with a plurality of supporting spokes 40 disposed equiangularly along the peripheral of the supporting bracket 20. Each of the supporting spokes 40 is provided with a supporting disk assembly 41 for an individual spool.

Figure 2:
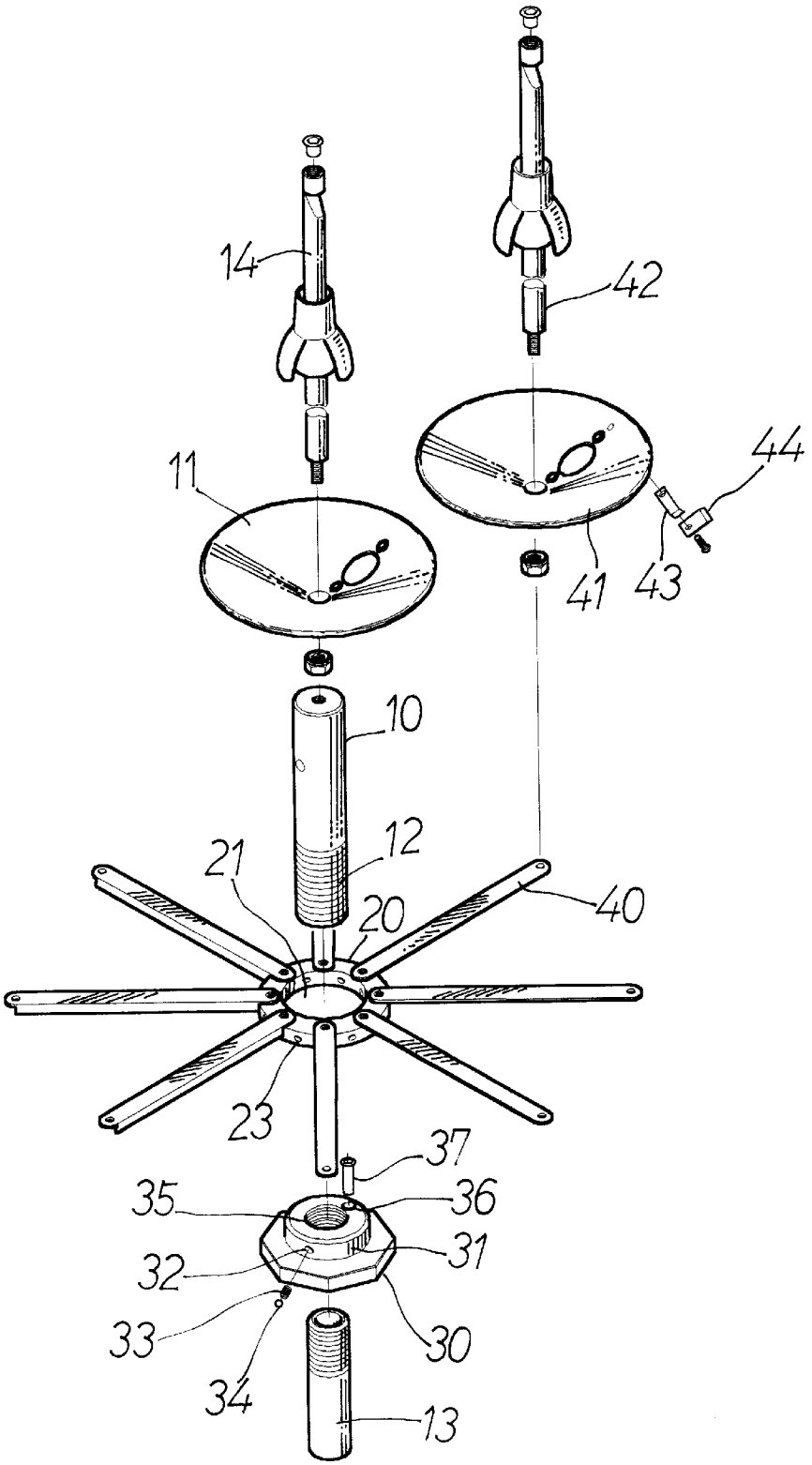
FIG. 2 is a partially exploded view of the supporting table shown in FIG. 1.

Referring to FIG. 2, the supporting bracket 20 has a ring shape configuration having an opening 21 at the central portion. One end of the spokes 40 is fixedly and equiangularly disposed at the peripheral of the supporting bracket 20. A radial through hole 23 is disposed between two adjacent spokes 40.

The positioning collar 30 has a polygonal shape and has a round plateau 31 at the top surface and which can be rotationally received within the central opening 21 of the supporting bracket 20. The round plateau 31 is also provided with a radial recess 32 having installed a biasing spring 33 and a ball 34 therein. The round plateau 31 further includes a blind hole 36 which is parallel to the axis of the threaded opening 35 for receiving a thread passing barrel 37 therein.

Figure 3:
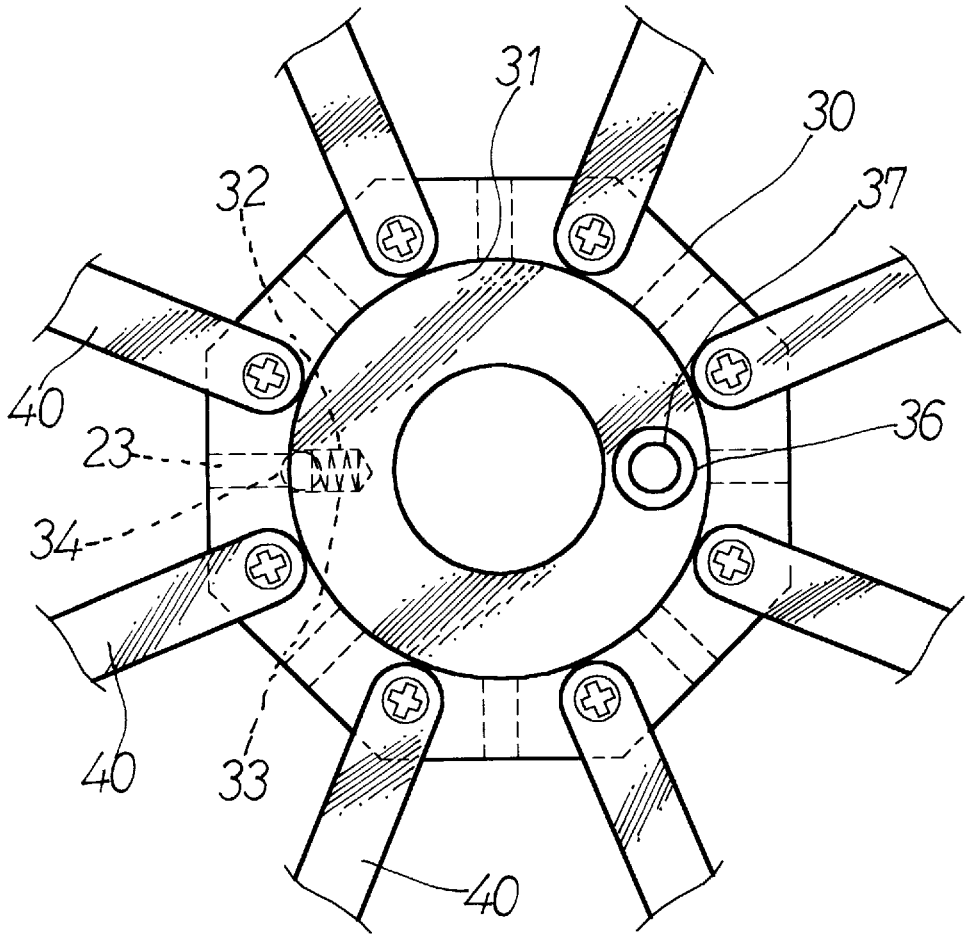
FIG. 3 is a top plan view showing the connection between the supporting bracket and the supporting posts.

Referring to FIGS. 2 and 3, when the supporting bracket 20 is enveloped onto the positioning collar 30 by the rotational engagement between the central opening 21 and the round plateau 31, the supporting bracket 20 can be readily positioned at a selected position with respect to the positioning collar 30 since the ball 34 is biased and projected into the radial through hole 23 of the supporting bracket 20, as clearly shown in FIG. 1. Since the radial through hole 23 is disposed between two adjacent spokes 40, as a result, a selected spool can be readily positioned at the desired position. If the user need to select another spool, the user may simply rotate the supporting bracket 20 such that the ball 34 is pressed inward by the inner wall of the opening 21 of the supporting bracket 20 and the ball 34 will be biased and projected when another radial through hole 23 comes closer.

Figure 4:
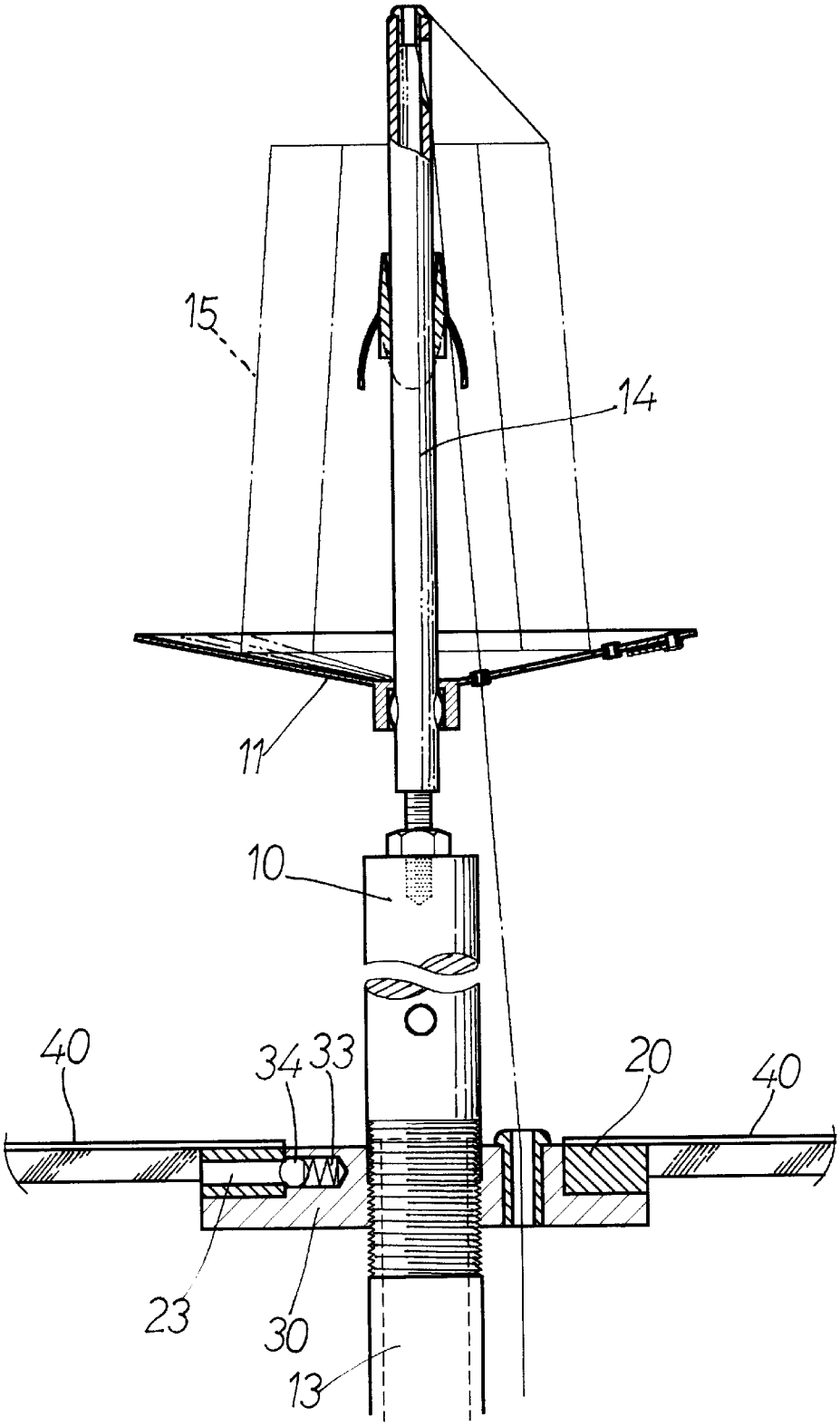
FIG. 4 is a cross sectional view showing the connection between the central supporting post and the supporting disks.

Referring to FIGS. 2 and 4, the supporting post 10 is provided with a threaded portion 12 at the bottom and can be fixedly connected to the supporting collar 30 by the engagement between the threaded portion 12 and the central threaded opening 35. A bottom supporting post 13 can be also connected to the supporting collar 30. The top of the supporting post 10 can be connected with a supporting disk 11 having a retaining post 14 at the central portion. A spool 15 can be rotationally disposed at the retaining post 14.

Figure 5:
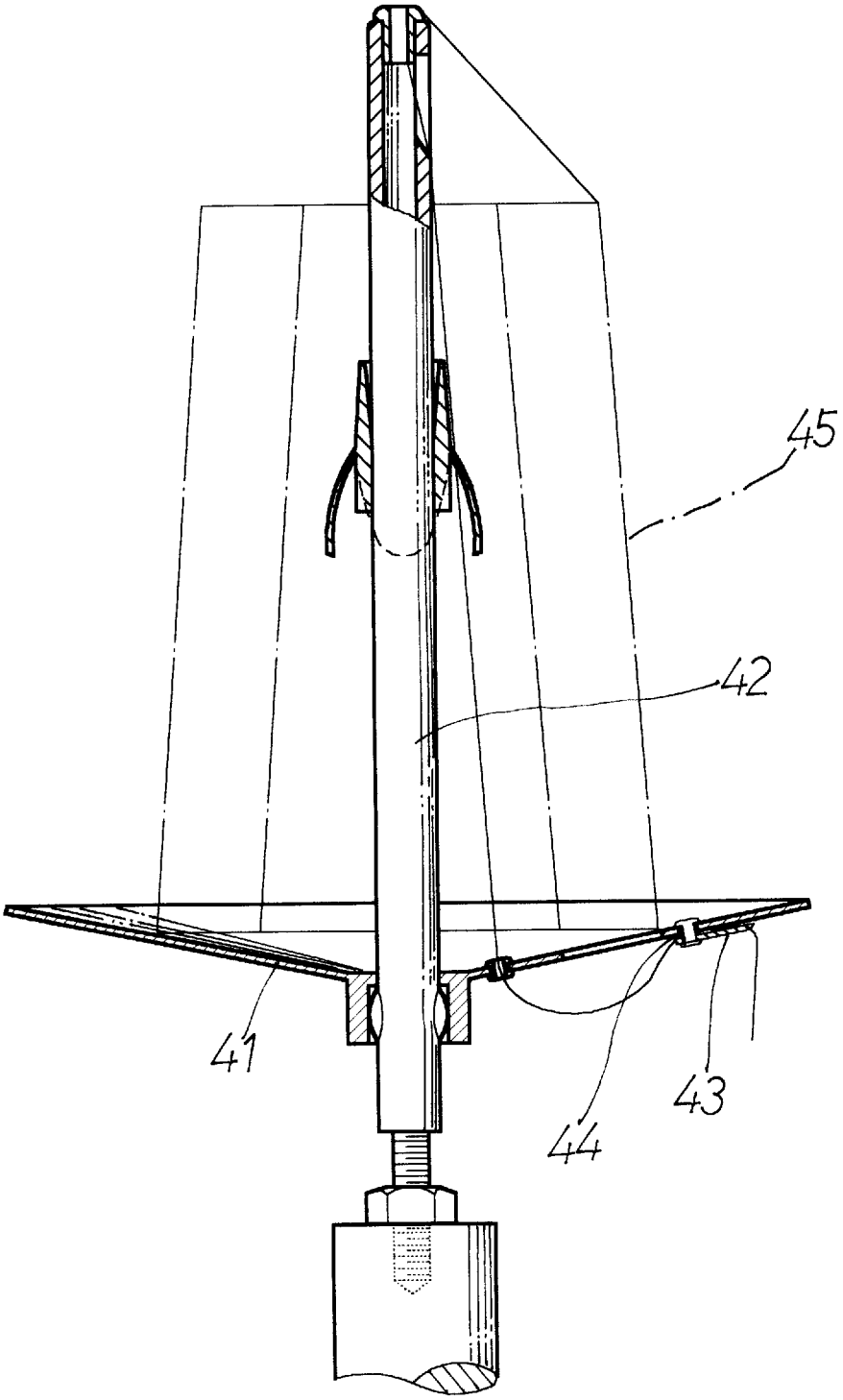
FIG. 5 is a cross sectional view showing a supporting disk shown in FIG. 1.

Referring to FIGS. 1 and 5, the supporting bracket 20 is disposed equiangularly with a plurality of spokes 40 and each of the spokes 40 is provided with a supporting disk 41 and retaining post 42. Each of the retaining posts 42 can be disposed with a spool with different color for backup application.

Figure 6:
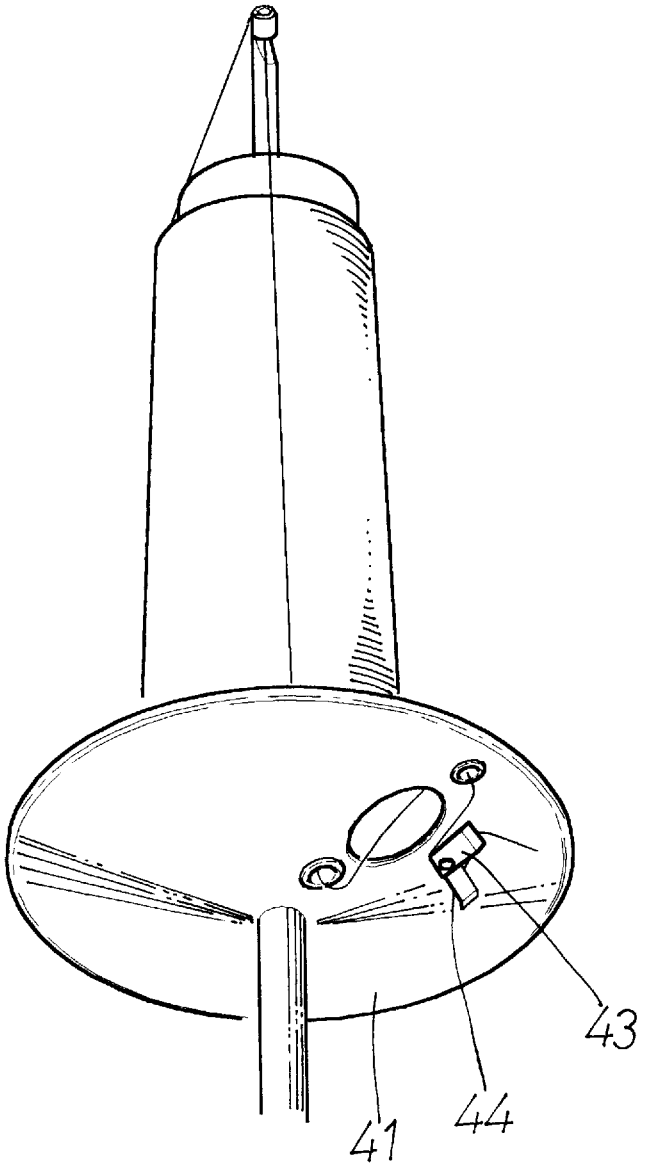
FIG. 6 is a perspective view showing the thread routing of the supporting disk shown in FIG. 5.

Referring to FIGS. 2, 5 and 6, in the preferred embodiment of the present invention, each of the retaining post 42 is disposed with a clipping plate 43 and a cutting blade 44 adjacent to a thread passing hole. When the spool 45 is not in use, the free end of the spool 45 can be firstly cut at suitable length by the cutting blade 44 and then is retained at the clipping plate 43, as shown in FIG. 5.

Figure 7:
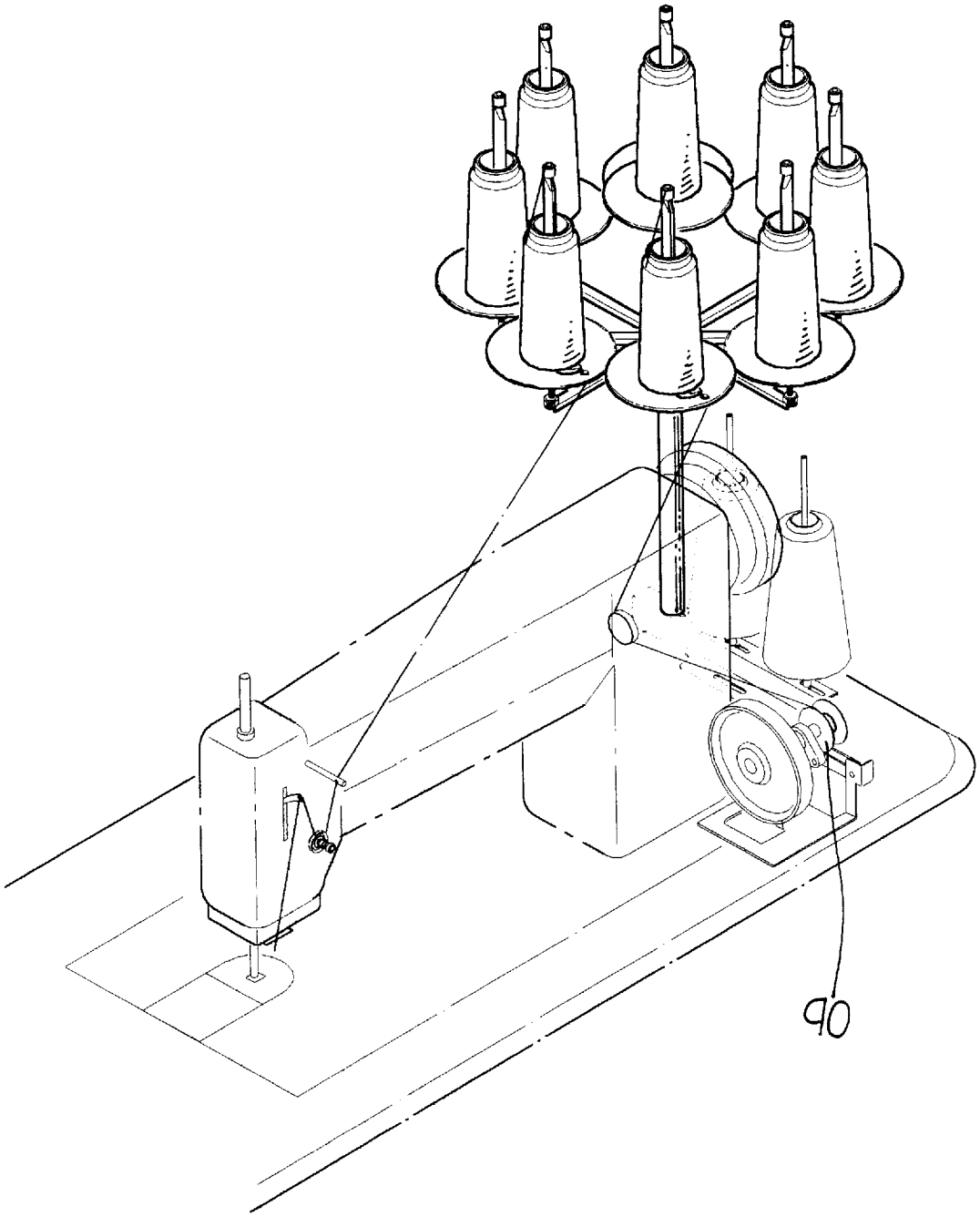
FIG. 7 is a schematic illustration showing the supporting table is mounted on a sewing machine.

As shown in FIG. 7, one of the backup spool can be connected with another winding wheel 90.

From the forgoing description, it can be readily appreciated that each of the backup spools are well positioned with the free end of the thread being clipped on the clipping plate 43. When a desired spool is to be used, the supporting bracket 20 can be readily positioned at a position and the thread wound on the spool can be readily released from the clipping plate 43 and directly put in use.

By this arrangement, spools of different colors and sizes can be readily and neatly disposed on the backup retaining posts for direct use. The conventional inconvenience is therefore solved.

I claim:

1. A supporting table for spools, comprising a supporting post;

a positioning collar being disposed at the lower portion of said supporting post, said positioning collar having a threaded central opening and a raised plateau;

a supporting bracket having a central opening and being rotationally enveloped onto said raised plateau of said positioning collar;

a plurality of spokes and each of said spokes being connected equiangularly to the peripheral of said supporting bracket, the other end of said spoke being provided with a supporting disk and a retaining post in which a spool can be releasably positioned thereof; and a positioning means which is disposed between said supporting collar and said supporting bracket such that said supporting bracket is selectively positioned with respect to said supporting collar.

2. A supporting table for spools as recited in claim 1, wherein said positioning means between said positioning collar and said supporting bracket comprises a plurality of radial through holes disposed equiangularly at said supporting bracket and a blind hole in which a biased spring and a ball are disposed therein, said ball can be positioned between said radial through hole and said blind hole such that said supporting bracket can be positioned with respect to said positioning collar.

3. A supporting table for spools as recited in claim 1, wherein each of the backup supporting disks is provided with a clipping plate and a cutting blade adjacent to a thread passing hole.

* * * * *